US005733064A

United States Patent [19]

Takada et al.

[11] Patent Number: 5,733,064

[45] Date of Patent: *Mar. 31, 1998

[54] DRAINAGE WATER PUMPING STATION AND METHOD FOR OPERATING THE SAME

[75] Inventors: Kunio Takada, Iwama-machi; Kenji Otani, Tsuchiura; Sadashi Tanaka, Chiyoda-machi, all of Japan

[73] Assignee: Hitachi, Ltd., Tokyo, Japan

[ * ] Notice: The term of this patent shall not extend beyond the expiration date of Pat. No. 5,603,289.

[21] Appl. No.: 753,911

[22] Filed: Dec. 3, 1996

Related U.S. Application Data

[63] Continuation of Ser. No. 554,832, Nov. 7, 1995, Pat. No. 5,603,587, which is a continuation of Ser. No. 332,089, Nov. 1, 1994, Pat. No. 5,498,105, which is a continuation of Ser. No. 900,418, Jun. 18, 1992, Pat. No. 5,360,289.

[30] Foreign Application Priority Data

Jun. 20, 1991 [JP] Japan ..... 3-148557

[51] Int. Cl.[6] ..... E02B 13/00

[52] U.S. Cl. ..... 405/52; 405/36

[58] Field of Search ..... 405/36, 37, 52–59, 405/80, 87; 210/170; 137/236.1, 567

[56] References Cited

U.S. PATENT DOCUMENTS 4,013,087 3/1977 Hanna ..... 137/567 X
4,997,312 3/1991 Regan ..... 405/36 X

OTHER PUBLICATIONS

Deep Underground Water Drainage Channel Water Drainage Pump System, Turbo Machines, vol. 21 No. 10.

*Primary Examiner*—Dennis L. Taylor
*Attorney, Agent, or Firm*—Antonelli, Terry, Stout, & Kraus, LLP

[57] ABSTRACT

A plural drainage pumps PH are disposed on the high floor gradation state at the circular shape. A plural drainage pumps PL are disposed on the low floor gradation state at the circular shape. The drainage pump PH disposed on the high floor gradation is installed at the high level. The drainage pump PH is set one having the low pump head and the large capacity in comparison with those of the drainage pump PL disposed on the low floor gradation. An outer shape of an underground pump construction building is formed a circular cone shape spreading toward an upper portion. The discharge water power can be reduced and the construction area for the underground pump construction building can be reduced and further the engineering working amount such as a digging working at the underground can be lessen.

3 Claims, 4 Drawing Sheets

DRAINAGE WATER PUMPING STATION AND METHOD FOR OPERATING THE SAME

This is a continuation of application Ser. No. 08/554,832, filed Nov. 7, 1995, now U.S. Pat. No. 5,603,587, which is a continuation of application Ser. No. 08/332,089, filed Nov. 1, 1994, now U.S. Pat. No. 5,498,105, which is a continuation of U.S. Ser. No. 07/900,418, filed Jun. 18, 1992, now U.S. Pat. No. 5,360,289.

DESCRIPTION OF THE INVENTION

1. Field of the Invention

The present invention relates to a drainage water pumping station and a method for operating the same, in particularly relates to a drainage water pumping station and a method for operating the same in the city and the outskirts of the city.

The drainage water pumping station in the present invention employs a construction for a drainage water system in which an inflow water main pipe line and a pump construction building are buried deeply under the ground.

2. Prior Art

At present, in the city so as to meet the problems about the flood caused by the rainfall and the inundation of the rivers etc., a drainage water system has been installed. This drainage water system is constructed such that a drainage water pumping station is provided on a down stream of an inflow water main pipe line and has a plural drainage pumps.

From a discharge water passage including the small rivers of the city and the outskirts of the city, the rainwater etc. are gathered into the inflow water main pipe line of the drainage water pumping station. Such a gathered inflow water is led into the drainage water pumping station and is discharged by means of the drainage pumps toward the rivers, the lakes and marshes or the sea as a discharge water flow destination.

Besides, in generally, in correspondence with the fluctuation of the inflow water amount, the discharge water amount is adjusted in accordance with the operation of the drainage pumps in the drainage water pumping station. Such drainage pumps are provided dividable with a plural number in response to the necessary discharge water amount. By controlling the running number of the drainage pumps the control or the adjustment for the discharge water amount is carried out in the drainage water pumping station.

Further, when an operator of the drainage water pumping station attends to control finely the discharge water amount, in generally it is carried out to combine a vane angle control of the drainage pump and a speed control of the drainage pump. By the reason of the difficulty for obtaining of the required area of land or the required area of site etc. for the equipment of the drainage water pumping station, the following drainage water system construction has been employed currently in the city.

The conventional drainage water system is constructed such that, the inflow water main pipe line is buried under the ground, namely the so-called underground river system is employed. Further, so as to fit the above inflow water main pipe line construction the drainage water pumping station itself is buried also under the ground.

A conventional underground drainage water pumping station is described in, for example, the document (Ehara Jihou No. 109, 1979, pages 13–16). According to this document, the following underground drainage water system in the city is mentioned.

The underground drainage water system shown in the above document comprises mainly an inflow water main pipe line which is disposed on the discharge water subject district, two pump wells and a plural drainage pumps surrounding two pump wells. The plural drainage pumps are arranged at the circular shape state surrounding to two pump wells.

In this underground drainage water system, two pump wells relating to two independent drainage water systems are provided independently with the same drainage water pumping station, and further surrounding to such two pump wells the plural drainage pumps relating to the respective drainage water system are arranged at the semi-circular shape state. These drainage pumps are arranged horizontally on only one flat plane or only single stage at the circular shape state. Further, a pump construction building in this drainage water system is formed to have a circular shape from upper end lower end and is arranged two pump well outside.

With the construction of the underground drainage water system stated above, by means of the inflow water main pipe line the inflow water is led into the pump wells of the drainage water pumping station. The control of the discharge water amount is corresponded to control the running number and the speed of the drainage pumps.

In the above stated underground drainage water system, in response to the enlargement of the discharge water subject district and the increase in the inflow water amount and further so as to make fully the installation route of the inflow water main pipe line and the dynamic water gradient, it develops a tendency to provide the great depth underground drainage water system in which both the inflow water main pipe line and the pump construction building are buried deeply under the ground.

However, when the great depth underground drainage water system is employed, the necessary pump head for the drainage pump becomes high in response to the buried installation depth of the inflow water main pipe line.

In the above stated prior art, it is necessary to operate all of the drainage pumps at the whole range from the minimum water level to the maximum water level of the pump well. As a result, it occurs the problems about the rises in the power cost for discharging the discharge water from the drainage pumps and the equipment cost of installing the pump construction building due to the necessity of the higher pump head for the drainage pump.

Further, the more the necessary number of the drainage pumps increases, the more the construction area (the projection area) for the pump installation construction building enlarges, accordingly the working amount including the underground digging working increases. Further, it occurs the problem about the increase in the construction cost etc. for constructing the pump construction building. In particular, it occurs the problem about the increase in the engineering working cost such as a digging working under the great depth underground.

SUMMARY OF THE INVENTION

An object of the present invention is to provide a drainage water pumping station wherein the power for running the drainage pumps can be reduced.

Another object of the present invention is to provide a drainage water pumping station wherein the construction area for constructing the pump construction building can be lessen.

A further object of the present invention is to provide a drainage water pumping station wherein the construction working amount such as a digging working under the great depth underground can be lessen.

A further object of the present invention is to provide a method for operating a drainage water pumping station wherein the power cost for discharging the discharge water from the drainage pumps can be reduced.

In accordance with the present invention, a drainage water pumping station comprises a pump well the rainwater etc. is flown through an inflow water main pipe line which is buried under the ground and a plural drainage pumps for discharging the inflow water in the pump well into the rivers etc. as a discharge water flow destination.

The plural drainage pumps are installed at a floor gradation state having at least more than two floors with a different installation level.

It is desirable to set each rating of each drainage pump from a high pump head to a low pump head and from a small capacity to a large capacity in order in proportion to a low floor gradation state to a high floor gradation state.

It is desirable to have the construction in which drainage pumps in the same stage floor gradation state are disposed at a circular shape state, a congregated delivery pipe line is installed lengthwise at a center of the circular shape of the drainage pumps, and each delivery pipe line of each drainage pump is connected to the congregated delivery pipe line.

Further, it is desirable to have the construction in which a ring-like congregated suction sump is installed concentrically with the circular shape state of the drainage pumps in communication with the pump well and each suction tube of each the drainage pump is connected to the congregated suction sump.

In accordance with the present invention, at least an outer shape of a low portion of the underground pump construction building installing the drainage pumps is formed a circular cone shape spreading toward an upper portion. The outer shape of the underground pump construction building installing the drainage pumps can be make to have the circular cone shape state spreading toward the upper portion at the lower portion and to have the circular column shape state at the upper station.

In accordance with the present invention, in the above stated drainage water pumping station construction, the drainage pumps are operated to start from the low floor gradation state to the high floor gradation state in order in proportion to a rise of the water level of the pump well.

With the above stated drainage water pumping station construction and the operating method for the drainage water pumping station, the present invention can be attained according to the following operations.

At first, in the case of the underground drainage water pumping station, in generally since the buried level of the inflow water main pipe line is low, in response to the such case the difference between the low water level and the high water level of the pump well relating to the running range of the drainage pumps becomes large.

Accordingly, when the plural drainage pumps are installed at the floor gradation state, since the difference between the water level of the rivers etc. as the discharge water flow destination and further the plural drainage pumps disposed on the high floor gradation state become small with a part of the high installation level of the drainage pumps, the necessary pump head becomes small enough to the above difference part, thereby the power for discharging the discharge water can be reduced.

In particularly, in the drainage water system when the water level of the pump well is low it can need the small discharge water amount, and the discharge water amount from the drainage water pumping station can be increased in proportion to the rise of the water level of the pump well.

Accordingly, as each rating of the drainage pump, it is desirable to set the more the plural drainage pumps are installed at the high floor gradation state the more the above plural drainage pumps have the low pump head and the large capacity.

Since the drainage pump having the low pump head and the large capacity has the high pump efficiency covering the wide range, the reduction effect in the discharge water power can be attained remarkably.

Further, since the plural drainage pumps are installed at the floor gradation state having at least more than two floors, the necessary construction area for the underground pump construction building can be made small.

Accordingly, the working amount including the underground digging working in the pump construction building can be reduced, and the increase in the construction cost can be restrained. In particularly, in the case that the plural drainage pumps in the same stage are arranged at the circular shape state the above stated effects can be attained remarkably.

Further, when the water level of the pump well is low it is unnecessary to discharge speedy the water not very, so that the plural drainage pumps disposed on the low floor gradation state become to have the high pump head but to may employ the small capacity.

Accordingly, the installation construction area of each floor gradation state of the underground pump construction building is made small in proportion to going to the low gradation state, when at least the outer shape of the low portion of the underground pump construction building is formed the circular cone state spreading toward the upper portion, then since the digging amount at the deep underground portion can be reduced, the reduction effects in the construction cost etc. can be attained remarkably.

DESCRIPTION OF THE INVENTION

Figure 1:
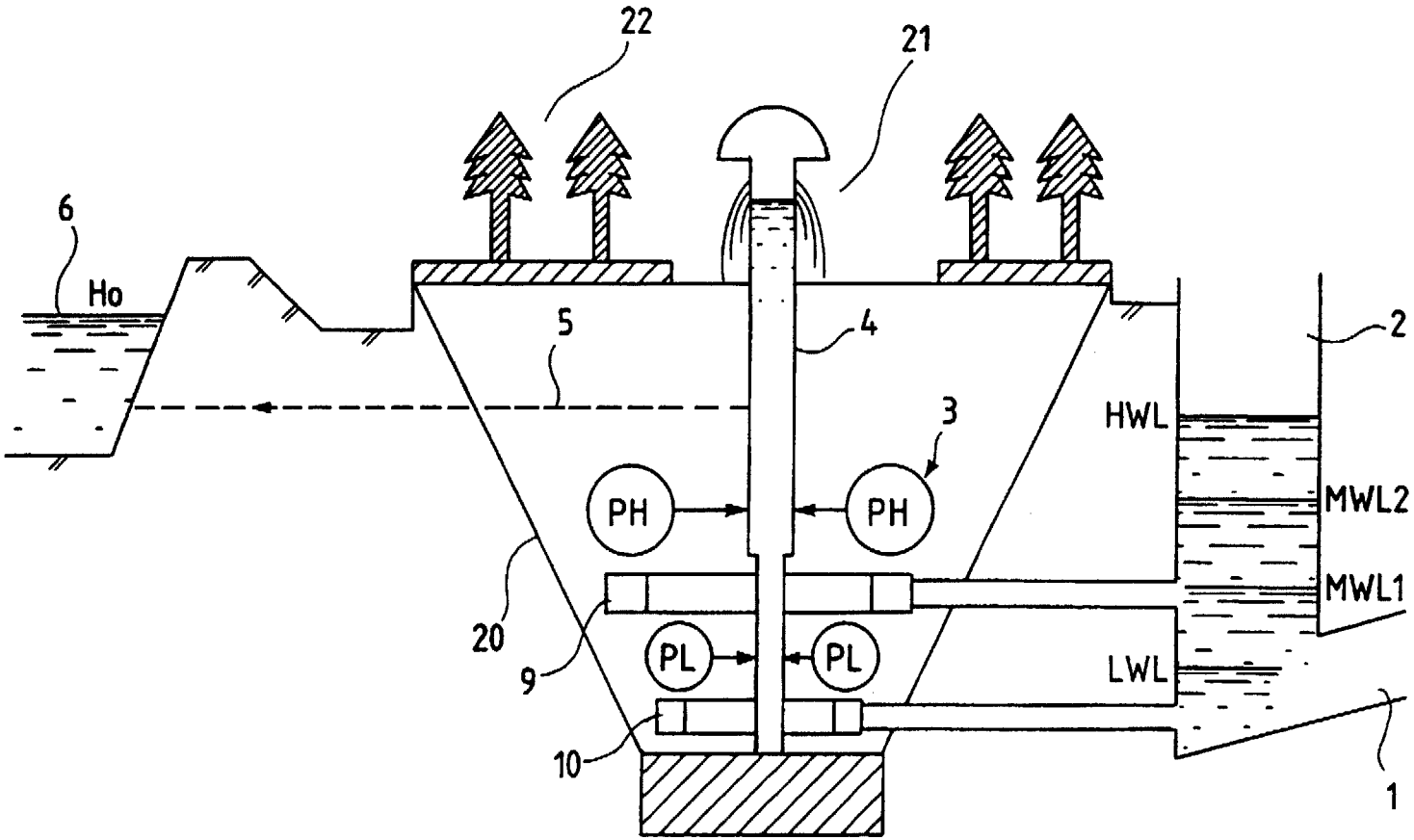
FIG. 1 is a longitudinal sectional schematic construction view showing one embodiment of a drainage water pumping station according to the present invention.

Hereinafter, one embodiment of a drainage water pumping station and a method for operating the drainage water pumping station according to the present invention will be explained referring to the drawings.

Figure 2:
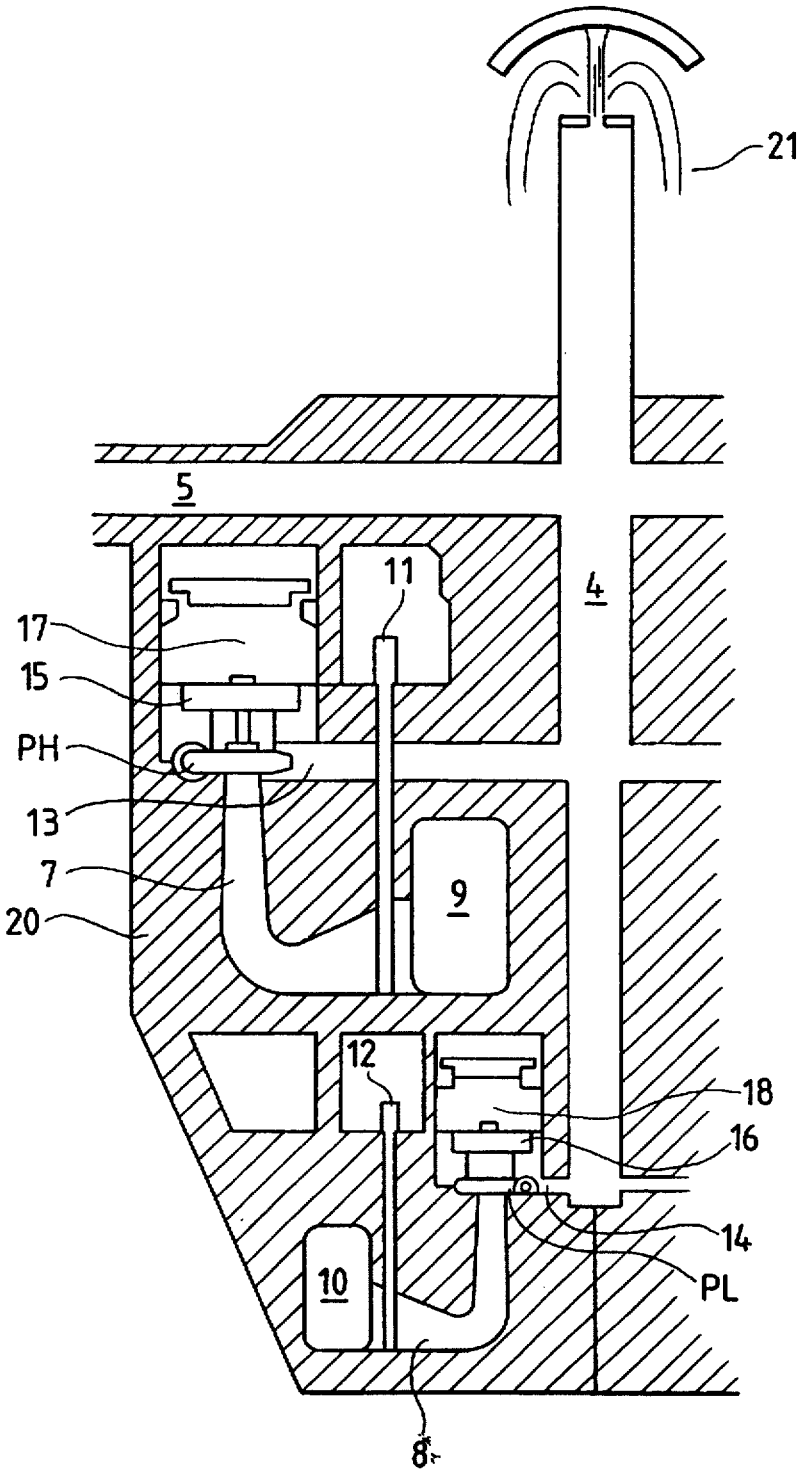
FIG. 2 is a detailed sectional view showing a section of a drainage pump arrangement of the drainage water pumping station shown in the embodiment of FIG. 1.

FIG. 1 shows a longitudinal sectional view showing a schematic construction of a drainage water pumping station of one embodiment according to the present invention. FIG. 2 shows a detailed view showing a section of a drainage pump arrangement of the drainage water pump station.

The inflow water such as the rainwater is gathered by an inflow water main pipe line 1 which is installed in the discharge water subject district and the inflow water flows into a pump well 2. The inflow water in the pump well 2 is pumped up by a group of plural drainage pumps 3 and discharged into the rivers 6 as a discharge water flow destination through a congregated delivery pipe line 4 and a drainage water passage 5.

The drainage pump group 3 in this embodiment is constructed with a first stage drainage pump group PH and a second stage drainage pump group PL. The first stage drainage pump group PH and the second stage drainage pump group PL are arranged at a state having two floors gradation state with a different installation level.

Herein, as the first stage drainage pump group PH having a low pump head and a large capacity is applied, besides as the second stage drainage pump group PL having a high pump head and a small capacity is applied. The first stage drainage pump group PH is disposed on the high floor gradation state (the upper floor gradation state) and the second stage drainage pump PL is disposed on the low floor gradation state. The first stage drainage pump group PH comprises a plural drainage pumps having a drainage pump PH1, a drainage pump PH2, . . . , and a drainage pump PHn (n: a natural number) is installed in the drainage water pumping station. Also, the second stage drainage pump group PL comprises a plural drainage pumps having a drainage pump PL1, a drainage pump PL2, . . . , and a drainage pump PLn (n: a natural number) is installed in the drainage water pumping station.

In this embodiment of the present invention, the first stage drainage pump group PH comprises four drainage pumps and also the second stage drainage pump group PL comprises four drainage pumps. However, it is preferable to install the first stage drainage pump group PH comprising from about minimum three drainage pumps to seven drainage pumps. Further, it is preferable to install the second stage drainage pump group PL comprising from about minimum three drainage pumps to seven drainage pumps.

In this embodiment of the present invention, two stage discharging pump group in the drainage water pumping station is exemplified, however three stages or four stages drainage pump group etc. can install in the drainage water pumping station.

Figure 3:
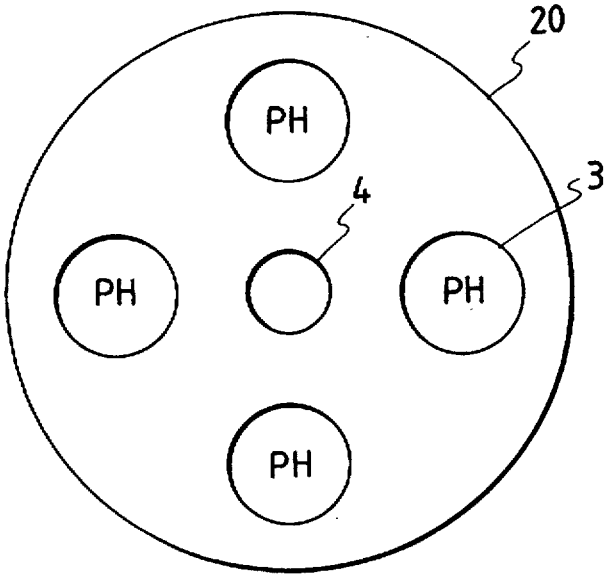
FIG. 3 is a schematic construction view showing a first stage drainage pump group disposed on a high floor gradation state.
Figure 4:
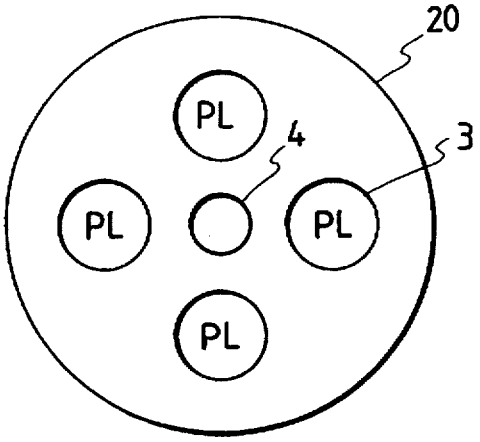
FIG. 4 is a schematic construction view showing a second stage drainage pump group disposed on a low floor gradation state.

Each of the drainage pump of the first stage drainage pump group PH is installed respectively at a floor gradation state with a circular shape state and is arranged symmetrically with same interval, as shown in FIG. 3. Each of the drainage pump of the second stage drainage pump group PL is installed respectively at a floor gradation state with a circular shape state and is arranged symmetrically with same interval, as shown in FIG. 4.

A suction tube 7 of the first stage drainage pump group PH is communicated with the pump well 2 through a ring-like congregated suction sump 9. A suction tube 8 of the second stage drainage pump group PL is communicated with the pump well 2 through a ring-like congregated suction sump 10.

Each of the congregated suction sump 9 and 10 is formed respectively at a circular shape state bringing into with the circular shape arrangement of the first stage and the second stage drainage pump group PH and PL. The suction tube 7 of the first stage drainage pump group PH provides a suction sluice valve 11. The suction tube 8 of the second stage drainage pump group PL provides a suction sluice valve 12.

The congregated delivery pipe line 4 is provided at a longitudinal shape state around the drainage pump group 3 and connects to each of a delivery pipe line 13 of the first stage drainage pump group PH and a delivery pipe line 14 of the second stage drainage pump group PL.

An upper portion of the congregated delivery pipe line 4 is communicated with the rivers 6 through the discharge water passage 5. A pipe diameter of the congregated delivery pipe line 4 is formed to get thinner toward the low floor gradation state bringing into with the discharge water amount of the floor gradation state each.

An underground pump construction building 20 installs the above drainage pump group 3 and is arranged at a side portion of the pump well 2. An outer shape of an underground pump construction building 20 is formed at a circular cone shape state having spreading toward the upper portion as shown in FIG. 1.

A reason for employing the above stated construction is such that the installation area of the second stage drainage pump group PL, which has the high pump head and the small capacity and is installed at the floor gradation of the lower state, can make small in comparison with that of the first stage drainage pump group PH, which has the low pump head and the large capacity and is installed at the floor gradation of the upper state.

An electric motor 15 is provided on each drainage pump of the first stage drainage pump group PH and an electric motor 16 is provided on each drainage pump of the second stage drainage pump group PL, respectively.

Further, as shown in FIG. 2, the underground pump construction building 20 can be formed to have the circular cone shape state spreading toward the upper portion at the lower portion and to have the circular column shape state at the upper portion. The outer shape of the underground pump construction building shown in FIG. 2 is a modified example with the outer shape of the underground pump construction building shown in FIG. 1. This underground pump construction building 20 provides maintenance areas 17 and 18 for maintaining the first stage and the second stage drainage pump group PH and PL and the motors 15 and 16.

As shown in FIG. 2, an upper end of the congregated delivery pipe line 4 is formed to expose or project over the ground. At the exposed portion of the congregated delivery pipe line 4, for example, it can provide the jet of water or the waterfall 21. Further, it can utilize the upper ground portion of the underground pump construction building 20 as the park 22 etc., as shown in FIG. 1.

The difference in level between the water level Ho of the rivers 6 as the discharge water flow destination and the installation level of the first stage drainage pump group PH is smaller than the difference in level between the water level Ho of the rivers 6 and the installation level of the second stage drainage pump group PL.

With the above drainage water pumping station construction, according to the embodiment of the present invention, as to the first stage drainage pump group PH disposed on the high floor gradation state, the facts will be explained as follow.

Namely, the difference in level between the water level Ho of the rivers 6 and the installation level of the first stage drainage pump group PH becomes smaller than that of the second stage drainage pump group PL, enough the high part in the installation level of the first stage drainage pump group PH in comparison with the second stage drainage pump group PL. The necessary pump head of the first stage drainage pump group PH becomes small enough to such a high part, therefore the discharge water power can be reduced.

In particularly, for the rating of the first stage drainage pump group PH disposed on the high floor gradation state it can employ the drainage pump having the ratings of the low pump head and the large capacity, such an employed low pump head and large capacity drainage pump has the high pump efficiency covering the wide range, therefore the reduction effect in the discharge water power can be attained remarkably.

Further, in the drainage water system, in a case that the water level of the pump well 2 is low, the discharge water amount may be small and in proportion to the rise of the water level of the pump well 2 the discharge water amount can make to increase.

For example, as shown in FIG. 1, at an intermediate portion between the low water level LWL (for example, water level: −60 m) of the pump well 2. and the low water level HWL (for example, water level: −15 m) of the pump well 2, an intermediate water level MWL1 (for example, water level: −45 m) and an intermediate water level MWL2 (for example, water level: −30 m) for controlling a running number in the drainage pump are set, respectively.

In accordance with the rise in the water level it can operate the first stage drainage pump group PH disposed on the high floor gradation state one after another, thereby the discharge, water power can be reduced effectively.

Further, since the first stage and the second stage drainage pump group PH and PL are installed at the floor gradation state having at least two floors, the necessary construction area for the underground pump construction building 20 can make small. As a result, the working amount including the underground digging working can be reduced and also the increase in the construction cost for the underground pump construction building 20 can be restrained.

In particularly, since each of the first stage and the second stage drainage pump group PH and PL is arranged respectively at the circular shape state, the outer shape of the underground pump construction building 20 can form to have the circular cone shape state as shown in FIG. 1, accordingly the reduction effect in the construction cost for constructing the underground pump construction building 20 can be attained remarkably.

Further, when the water level of the pump well 2 is low, then it is unnecessary to discharge speedy the water not very, the second stage drainage pump group PL disposed on the low floor gradation state has the high pump head and so that the second stage drainage pump group PL may have the small capacity.

Accordingly, the construction area for each floor gradation state of the underground construction building 20 is made small gradually in compliance with going to the low floor gradation state. When at least the outer shape of the low portion of the underground pump construction building 20 makes to form the circular cone state spreading toward the upper portion, in particularly since the digging amount at the deep underground portion can be reduced, therefore the reduction effect in the construction cost of the underground pump construction building 20 can be attained remarkably.

Herein, one example of the reduction effect in the discharge water power according to the embodiment of the present invention will be explained referring to FIG. 5.

Figure 5:
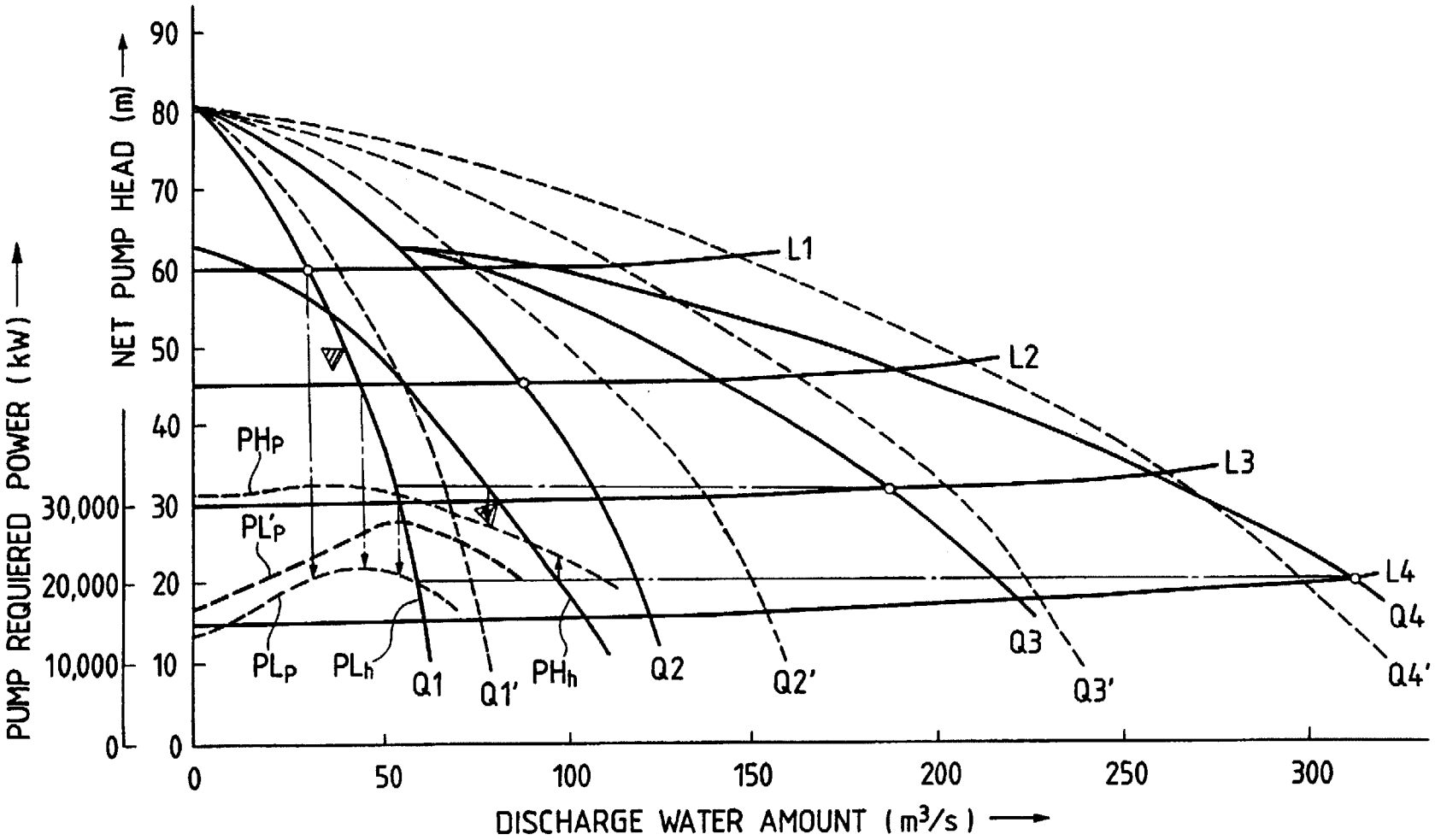
FIG. 5 is a chart for explaining the effects according to the embodiment shown in FIG. 1 and showing a characteristic curve line Q between a discharge water amount ($m^3/s$) and a total pump head (m) of a parallel running number the drainage pump group, a characteristic curve line P between a discharge water amount ($m^3/s$) and a pump required (kW) per single drainage pump, and a loss curve line L of the individually parallel running number of the drainage pump.

FIG. 5 shows a characteristic curve line Q of a discharge water amount ($m^3/s$) and a total pump head (m) of a parallel running number of the drainage pump group, a characteristic curve line P of a discharge water amount ($m^3/s$) and a pump required (kW) per single drainage pump, and a loss curve line L of the individual parallel running number of the drainage pump, respectively.

The installation number end the rating of the first stage and the second stage drainage pump group PH and PL according to one example of the present invention and the installation number and the rating of the drainage pump group PL' according to the comparative example are shown in Table 1.

In this comparative example, all of the drainage pumps of the drainage pump group PL' have the same rating, further these drainage pumps of the drainage pump group PL' are installed at the low floor gradation of the above embodiment of the present invention, namely similar to the second stage drainage pump group PL.

TABLE 1

| (Example of the Present Invention) | |
|---|---|
| Drainage pump PH disposed on high gradation floor | |
| number | 2 |
| rate pump head | 30 m |
| rate capacity | 82 $m^3/s$ |
| rate pump required power | 35 MW |
| Drainage pump PL disposed on low gradation floor | |
| number | 2 |
| rate pump head | 50 m |
| rate capacity | 40 $m^3/s$ |
| rate pump required power | 35 MW |
| (Comparative Example) | |
| Drainage pump PH disposed on high gradation floor | |
| number | 4 |
| rate pump head | 50 m |
| rate capacity | 50 $m^3/s$ |
| rate pump required power | 30 MW |

Further, in FIG. 5, the real lines show the drainage pumps of the embodiment according to the present invention and the broken lines show the drainage pumps according to the comparative example, and an affixed number attached to the reference code of each curve line indicates to a parallel running number of the drainage pumps. Each of the characteristic curve line Q1, Q2, Q3 and Q4 shows the discharge water amount and the total pump head under one number running pump condition, two number running pump condition, three number running pump condition and four number running pump condition, according to the present invention. Each of the characteristic curve line Q1', Q2', Q3' and Q4' shows the discharge water amount and the total pump head under one number running pump condition, two number running pump condition, three number running pump condition and four number running pump condition, according to the prior art.

A characteristic curve line $PH_h$ shows the pump net head of the first stage drainage pump group PH according to the present invention. A characteristic curve line $PL_h$ shows the pump net head of the first stage drainage pump group PL according to the present invention.

A characteristic curve line PHp shows the discharge water amount and the pump required power of the first stage drainage pump group PH according to the present invention.

A characteristic curve line PLp shows the discharge water amount and the pump required power of the second stage drainage pump group PL according to the present invention. A characteristic curve line PL'p shows the discharge water amount and pump required power of the drainage pump group according to the prior art.

Each of the characteristic curve L1, L2, L3 and L4 shows the loss curve line under one number running pump condition, two number running pump condition, three number running pump condition and four number running pump condition according to the present invention.

In FIG. 5 and the above stated conditions, the running number of the drainage pumps had controlled in accordance with the change in the water level of the pump well 2. As a result, in a case that the time in one number running, two number running, three number running and four number running in the drainage pumps is one hour, respectively, and further the necessary discharge water power for the drainage pumps had requested and can be obtained the following results as shown in Table 2.

TABLE 2

| (Example of the Present Invention) |
|---|
| Required discharge water power (MWH) |
| 1 number × 20 MWH |
| 2 number × 21.5 MWH |
| 2 number × 20.7 MWH + 1 number × 27 MWH |
| 2 number × 20 MWH + 2 number × 23 MWH |
| Total 217.4 MWH |
| (Comparative Example) |
| Required discahrge water power (MWH) |
| 1 number × 25 MWH |
| 2 number × 27 MWH |
| 3 number × 26 MWH |
| 4 number × 25 MWH |
| Total 257 MWH |

As shown from the above calculation results, the necessary discharge water power in the embodiment according to the present invention can be reduced to about 85% in comparison with the prior art shown in the comparative example.

The above results are caused mainly by the following conditions. Since the first stage drainage pump group PH having the low pump head and the large capacity has the high pump efficiency covering the wide range of the discharge water amount, the first stage and the second stage drainage pump group PH and PL are installed at the floor gradation state with the different installation level as shown in this embodiment according to the present invention.

Further the rating of the first stage drainage pump group PH disposed on the high floor gradation state is set to have the low pump head and the large capacity in comparison with the second stage drainage pump group PL disposed on the low floor gradation state.

As explained above, according to the embodiment of the present invention the following various remarkable effects can be obtained.

Each of the first stage and the second stage drainage pump group PH and PL is installed respectively at the different floor gradation state, as to the first stage drainage pump group PH disposed on the high gradation state since the difference in the installation level with respect to the water level Ho of the rivers 6 as the discharge water flow destination becomes small enough to the high part of the installation level in comparison with that of the second stage drainage pump group PL.

Accordingly, the necessary pump head in the first stage drainage pump group PH becomes small enough such a high part, therefore the discharge water power in the first stage drainage pump group PH can be reduced.

In particularly, as the rating of the first stage drainage pump group PH disposed on the high floor gradation state, when the ratings of the low pump head and the large capacity for the first stage drainage pump group PH are employed, since such an employed low pump head and large capacity pump has the high pump efficiency covering the wide range, the reduction effect in the discharge water power in the first stage drainage pump group PH can be attained remarkably.

Further, since the first stage and the second stage drainage pump group PH and PL are installed at the gradation state having two floors, the necessary construction area of the underground pump construction building 20 can make small.

As a result, the working amount including the underground digging working can be reduced and further the increase in the construction cost for the underground pump construction building 20 can be restrained. In particularly, when the first stage and the second stage drainage pump group PH and PL are arranged at the circular shape state, the above stated reduction effects can be attained remarkably.

When the water level of the pump well 2 is low, it is unnecessary to discharge speedy the water not very, the second stage drainage pump group PL disposed on the low floor gradation state has the high pump head and the second stage drainage pump group PL may employ the small capacity.

Accordingly, the construction area at each floor gradation state of the underground pump construction building 20 can make small in proportion to going to the lower floor gradation state. When at least the outer shape of the low potion of the underground pump construction building 20 is formed to have the circular cone state spreading toward the upper portion, in particularly the digging amount at the deep underground portion can be reduced, therefore the reduction effect in the construction cost for constructing the underground pump construction building 20 can be attained remarkably.

Further, according to the increase in the water level of the pump well 2, the operation of the first stage and the second stage drainage pump group PH and PL can start from the low floor gradation state (the second stage drainage pump group PL) to the high floor gradation state (the first stage drainage pump group PH) in order. Therefore, since it is need not to operate unnecessarily the drainage pump at the low pump head, thereby the discharge water power can be reduced effectively.

We claim:

1. A drainage water pump station, comprising:

a pump well for receiving drainage water;

a plurality of drainage pumps for discharging drainage water from said pump well to a discharge destination outside said pump well;

a congregated discharge water passage connecting said plurality of drainage pumps to said discharge destination; and a congregated suction water channel communicating said pump well and said plurality of drainage pumps.

2. A drainage water pump station according to claim 1, wherein:

at least one drainage pump is at a lower level of said pump well, to be operated at a low water level of said pump well, and all said drainage pumps are operated at a high water level of said pump well.

3. A drainage water pump station, comprising:

a pump well into which drainage water can flow through an underground inflow main water passage;

a plurality of drainage pumps for discharging drainage water from said pump well to a discharge destination outside said pump well;

a congregated discharge water passage connecting said plurality of drainage pumps to said discharge destination; and a congregated suction water channel communicating between said pump well and said plurality of drainage pumps;

wherein:

said plurality of drainage pumps include a low capacity pump at a low water level of said pump well, and a high capacity pump at a high water level of said pump well.

* * * * *

UNITED STATES PATENT AND TRADEMARK OFFICE

CERTIFICATE OF CORRECTION

PATENT NO. : 5,733,064

DATED : March 31, 1998

INVENTOR(S) : Takada et al.

It is certified that error appears in the above-indentified patent and that said Letters Patent is hereby corrected as shown below:

On title page,

The disclaimer notice should read:

[*] Notice: The term of this patent shall not extend beyond the expiration date of Patent No. 5,603,587

Signed and Sealed this

Fourteenth Day of July, 1998

Bruce Lehman

*Attest:*

BRUCE LEHMAN

*Attesting Officer*

*Commissioner of Patents and Trademarks*